US008398134B1

(12) United States Patent
Mortensen

(10) Patent No.: US 8,398,134 B1
(45) Date of Patent: Mar. 19, 2013

(54) UNIVERSAL CARABINER HOLDER

(75) Inventor: Stephen Mortensen, Vernal, UT (US)

(73) Assignee: Quasar Services, Vernal, UT (US)

( * ) Notice: Subject to any disclaimer, the term of this patent is extended or adjusted under 35 U.S.C. 154(b) by 529 days.

(21) Appl. No.: 12/610,790

(22) Filed: Nov. 2, 2009

Related U.S. Application Data

(60) Provisional application No. 61/112,100, filed on Nov. 6, 2008.

(51) Int. Cl.
*B66F 19/00* (2006.01)

(52) U.S. Cl. ..... 294/191; 294/104; 294/175; 248/925

(58) Field of Classification Search ..... 294/209, 294/24, 175, 82.34, 174, 191, 210, 104; 24/265 AL, 24/182, 200; 114/221 R, 230.1; 248/225.21, 248/224.8, 227.1, 925; 269/3, 6, 95, 143
See application file for complete search history.

(56) References Cited

U.S. PATENT DOCUMENTS

| | | | | | |
|---|---|---|---|---|---|
| 103,627 | A | * | 5/1870 | Lamb | 294/24 |
| 635,543 | A | * | 10/1899 | Herr | 119/808 |
| 1,536,701 | A | | 5/1925 | Buckingham et al. | |
| 1,852,629 | A | | 6/1931 | Sturges | |
| 1,865,526 | A | * | 7/1932 | Lawlor | 294/175 |
| 2,116,880 | A | | 5/1938 | Dee | |
| 2,204,482 | A | | 6/1940 | Filipiak | |
| 2,275,903 | A | * | 3/1942 | Hermann | 294/174 |
| 2,979,013 | A | | 4/1961 | Whittall | |
| 3,098,462 | A | | 7/1963 | Holzman | |
| 3,913,515 | A | | 10/1975 | Hernsjo et al. | |
| 4,595,223 | A | | 6/1986 | Hawie | |
| 4,793,646 | A | | 12/1988 | Michaud, Jr. | |
| 4,986,207 | A | | 1/1991 | Reed | |
| 5,116,260 | A | | 5/1992 | Upchurch | |
| 5,275,452 | A | * | 1/1994 | Cleveland | 294/82.32 |
| 5,454,611 | A | | 10/1995 | Wanat | |
| 5,622,399 | A | | 4/1997 | Albright | |
| 5,820,181 | A | | 10/1998 | Le Noach | |
| 6,022,059 | A | | 2/2000 | Regamey | |
| 6,193,432 | B1 | | 2/2001 | Kampfert | |
| 6,409,240 | B1 | | 6/2002 | Ferguson | |
| 6,412,432 | B1 | | 7/2002 | White et al. | |
| 6,510,599 | B2 | | 1/2003 | AmRhein | |
| 7,036,780 | B1 | | 5/2006 | Geninatti | |
| 7,216,906 | B2 | | 5/2007 | Barrett | |
| 7,571,944 | B2 | | 8/2009 | Mortensen | |
| 2004/0189028 | A1 | * | 9/2004 | Newman et al. | 294/19.1 |
| 2005/0183904 | A1 | | 8/2005 | Bacalso | |

OTHER PUBLICATIONS http://www.liftingsafety.co.uk/product/show/prodid/2322.html; Selby Engineering and Lifting Safety Ltd; accessed Oct. 24, 2008, 1 page.

(Continued)

*Primary Examiner* — Dean Kramer
*Assistant Examiner* — Stephen Vu
(74) *Attorney, Agent, or Firm* — Thrope North & Western LLP

(57) ABSTRACT

A universal safety and rescue carabiner holder is disclosed for securing a carabiner with its gate in the open position while extending the user's reach several feet in any direction, which is also capable of supporting a long and heavy segment of attached safety rope. The carabiner holder is mounted to the end of an extension pole and includes an axial stem, gripping means supported by the axial stem for releasably capturing the spine of the carabiner and for holding the carabiner's gate arm in an open position, and supporting means supported by the axial stem opposite the gripping means for restraining the base of the carabiner. An axial gap defined by the gripping means and the supporting means is variable to accommodate a broad selection of carabiners have a wide variety of sizes, shapes and gate arm configurations.

19 Claims, 12 Drawing Sheets

OTHER PUBLICATIONS http://www.epicsport.com/; Epic Sport Home Page; "Epic Sport Innovative Products for Outdoor Enthusiasts"; accessed Sep. 18, 2008, 2 pages.

http://www.epicsport.com/products.300.html; Epic Sport Product Page; "The tool for clipping beyond your reach."; accessed Sep. 18, 2008, 2 pages.

* cited by examiner

UNIVERSAL CARABINER HOLDER

RELATED APPLICATIONS

This application claims the benefit of U.S. Provisional Application No. 61/112,100, filed Nov. 6, 2008, and entitled "Universal Carabiner Holder," which application is incorporated by reference in its entirety herein.

FIELD OF THE INVENTION

The field of the invention relates to safety and rescue operations and, more specifically, to a carabiner holder for coupling a carabiner with its attached safety rope to a ring on the safety harness of a fallen or otherwise incapacitated worker.

BACKGROUND OF THE INVENTION AND RELATED ART

It is common for workers employed in the construction and maintenance aspects of any heavy industry to enter into hazardous situations during their normal scope of employment. Examples of such activities include digging trenches for pipelines, entering confined spaces such as sewers or large storage tanks, and climbing on the exteriors of tall structures such as buildings, process columns, exhaust flumes or power line towers. Great efforts have been expended through the implementation of OSHA regulations to minimize the risk of such activities, and workers are now required to wear standard safety gear, follow specific safety procedures, and often must continuously monitor the surrounding environment with specialized sensors.

Regrettably, unforeseen circumstances sometimes occur or mistakes are made which render a worker incapacitated and unable to extract him/herself from a dangerous situation, and where it would be equally hazardous for rescue team members to enter and attempt to retrieve the fallen individual in person. In such circumstances it is better for the rescue team to first attempt an extraction by remotely attaching an auto-locking carabiner and safety rope to a ring or hanger on the fallen co-worker's safety harness and pulling the individual to safety.

This non-committal rescue is accomplished by means of a carabiner holder mounted to the end of an extension pole. The user manipulates the extension pole to secure the carabiner into position about the ring or hanger, and then releases the carabiner to allow the carabiner holder to be withdrawn.

Unfortunately, the current state of the art for carabiner holders does not satisfy the needs of the safety and rescue sector. During a rescue operation, the ability to extend the reach of the rescuer in any orientation is of primary concern. But it is especially critical when the fallen worker lies downward and away from the rescuer's location, such as in a trench, down a sewer manhole, in a ventilation shaft, or lower on the face of a tall structure. In this orientation the weight of the rescue rope, which is often denser and heavier than typical climbing ropes, acts crosswise to the orientation to the extension pole and tends to pull the carabiner out of its holder before it can be attached to the incapacitated worker's safety harness.

Furthermore, a rescuer is likely to be nervous or agitated during an emergency and may be unable to hold the extension pole completely steady. If the rescuer does bounce the extension pole while attempting to attach the carabiner, these shocks will increase the probability that the carabiner will fall out of the holder before it can be attached to the harness. It is therefore vital that the carabiner holder be capable of securing the carabiner firmly in any orientation while supporting a substantial section of free-hanging safety rope, and at the same time withstanding any additional forces generated by rescuers.

The carabiner holders presently available have been adapted from the climbing industry and are not sufficiently strong or robust enough to provide reliable operation in an emergency situation. For instance, the carabiner holder used by climbers is principally designed to extend the climber's reach directly overhead to hangers that lie beyond arm's length. In this orientation the weight of the free-hanging rope attached to the carabiner serves to better seat the carabiner into the carabiner holder. If the carabiner holder is extended too far to one side or the other, however, the weight of the rope tends to pull the carabiner out of position, possibly making the carabiner inoperable or to fall out of the holder altogether. In a climbing situation this is not too great of an issue, as there is usually ample time for the climber to pull the carabiner back, re-attach it to the holder and try again. However, such unreliable operation in an emergency situation could prove fatal to the fallen party.

Existing carabiner holder designs are also complicated to operate, as they require special manipulation of the holder when connecting the carabiner to a ring or hanger, or they call for twisting or pushing the extension pole to one side to release the carabiner from the holder after it has been attached to the safety harness. Such procedures may be forgotten or overlooked by a would-be rescuer in the heat of the moment, slowing down or hindering the speed of the rescue operation.

Furthermore, in the climbing industry it also is standard practice to manufacture components from lightweight plastic, thin-wall aluminum or specialized polymer fibers in order to minimize the total weight a climber must carry with him. Current carabiner holders follow this pattern, and several commercial products are made from plastic components with pieces that could easily break off if handled improperly. Industrial safety and rescue teams are not limited by such weight constraints, but instead require a carabiner holder made from heavy-duty components that can withstand the rigors of an industrial work environment and still function correctly when pressed into service for the first time.

Likewise, the carabiners used in safety and rescue operations are typically larger and designed for heavier duty than their counterparts used in climbing. The carabiners also come in a variety of sizes and configurations, with each carabiner manufacturer providing a product having its own unique shape and/or auto-locking gate arm configuration. Existing carabiner holders are limited in that they must be sized to match a particular carabiner, which typically prevents the holder from being used with a carabiner of a differing size, from another manufacturer, or which uses a different auto-locking gate arm configuration. This selectivity creates an additional burden on the safety and rescue team to ensure that the carabiner and carabiner holders are procured and/or operate well together, and that the holders and matched carabiners are kept separate from other equipment to ensure there are no mis-matches that could delay a response in an emergency situation.

What is needed, therefore, is a carabiner holder that meets the special requirements of the safety and rescue sector. The carabiner holder must be durable and robust with the capability of withstanding some physical abuse and still providing reliable operation when an emergency situation arises. The device should be compatible with a broad selection of carabiners made by differing manufacturers and which can come in a wide variety of sizes, shapes and gate arm configurations. The device must also be simple to use, as rescuers can often be nervous or agitated when time constraints dictate that a fallen coworker or friend be retrieved as soon as possible. And finally, the holder must provide reliable operation in any orientation, and not allow the carabiner to fall out of position or out of the holder prematurely if the individual to be rescued is located in an awkward position.

SUMMARY OF THE INVENTION

The safety and rescue carabiner holder of the present invention is a device that overcomes the deficiencies of existing carabiner holders. The holder is compatible with a wide variety of carabiners made by differing manufacturers and which can come in differing sizes, shapes and gate arm configurations. When attached to an extension pole, it is capable of securely holding a carabiner with its gate arm in the open position while extending the user's reach several feet in any direction, all the while supporting a long and heavy segment of attached safety rope, or even the weight of a small block and tackle. The spring-loaded griping mechanism and biased base support of the carabiner holder together grasp the carabiner within the holder with sufficient security to withstand shaking and bouncing, but which also allow for easy release after attachment of the carabiner to a ring through simple manipulation of the safety rope and extension pole.

In accordance with the invention as embodied and broadly described herein, the present invention resides in a carabiner holder that is configured for mounting on an extension pole for holding and remotely installing a carabiner. The carabiner holder includes an axial stem for facilitating support of the carabiner, gripping means extending from the axial stem for releasably capturing a spine of the carabiner and for holding a gate arm of the carabiner in an open position, supporting means extending from the axial stem opposite the gripping means for restraining a base of the carabiner, and wherein an axial gap defined by the gripping means and the supporting means is variable to accommodate a plurality of carabiners of different sizes or makes.

In one aspect of the above embodiment, the gripping means is fixed relative to the axial stem and the supporting means is resilient in the axial direction for providing the variable axial gap, with the supporting means being biased towards the gripping means. In another aspect of the above embodiment, the axial stem further comprises a first axial component for supporting the gripping means and a second axial component for supporting the supporting means, wherein the first axial component and the second axial component are moveable with respect to each other, and wherein the first axial component and the second axial component are biased towards each other.

In accordance with another representative embodiment as broadly described herein, the present invention resides in carabiner holder for holding and remotely installing a carabiner. The carabiner holder includes an axial stem mountable to an extension pole, a pair of separable jaw arms extending from an upper portion of the axial stem and biased towards a closed position for releasably capturing a spine of the carabiner, and a resilient or moveable base support extending from a lower portion of the axial stem for restraining a base of the carabiner. The moveable base support is biased towards the jaw arms to hold a gate arm of the carabiner in an open position against an underside of a jaw arm.

In accordance with yet another representative embodiment as broadly described herein, the present invention resides in a rescue system for remotely attaching a safety rope to an attachment ring of a safety harness. The rescue system includes a carabiner having a base, a spine, a hook portion and a pivotable gate arm, where the base, spine, hook portion and gate arm together form an annular body when the gate arm is in the closed position. The rescue system also includes a safety rope coupled to the carabiner. The rescue system further includes a carabiner holder supported on an extension pole that comprises an axial stem, a pair of separable and biased jaw arms extending from an upper portion of the axial stem for releasably capturing a spine of the carabiner, and a resilient or moveable base support extending from a lower portion of the axial stem and which is biased towards the jaw arms, for restraining a base of the carabiner while releasably securing a gate arm of the carabiner in an open position against an underside of a jaw arm.

In accordance with yet another representative embodiment as broadly described herein, the present invention resides in a method for locking a carabiner into a remote ring or hanger. The method includes the step of obtaining a carabiner holder coupled to an extension pole, with the carabiner holder comprising an axial stem having a gripping means at a first end, a supporting means at a second end, and an axial gap between the gripping means and the supporting means. The method also includes the steps of positioning the carabiner with an attached rope within carabiner holder, with a spine portion of the carabiner releasably captured by the gripping means and a base portion of the carabiner restrained by the support means, causing the axial gap to expand while placing a gate arm of the carabiner adjacent or within the gripping means and exposing a hook portion of the carabiner, and allowing the axial gap to contract and releasably secure the gate arm with the gripping means. The method further includes the steps of extending the extension pole to place the exposed hook portion of the carabiner into the remote ring or hanger, and causing the axial gap to expand and release the gate arm from the gripping means to lock the carabiner about the remote ring or hanger.

BRIEF DESCRIPTION OF THE DRAWINGS

Features and advantages of the invention will be apparent from the detailed description that follows, and which taken in conjunction with the accompanying drawings, together illustrate features of the invention. It is understood that these drawings merely depict exemplary embodiments of the present invention and are not, therefore, to be considered limiting of its scope. And furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

Figure 1:
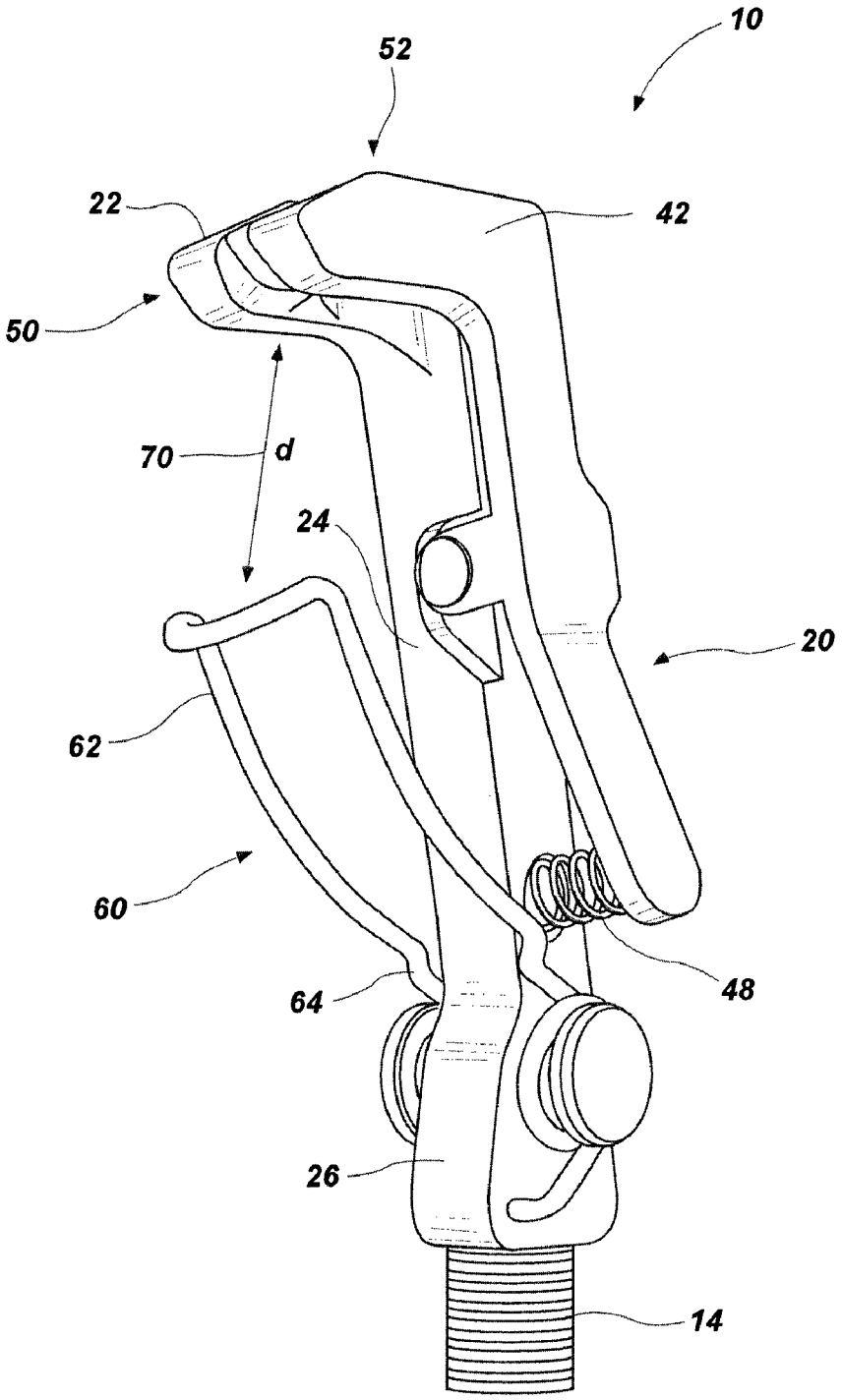
FIG. 1 illustrates a perspective view of a universal carabiner holder, in accordance with an exemplary embodiment of the present invention.

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best understood with reference to the accompanying drawings, wherein the elements and features of the embodiments are designated by numerals throughout.

Illustrated in FIGS. 1-17 are several representative embodiments of a universal carabiner holder, which embodiments also include various methods for using the carabiner holder to lock a carabiner into a remote object, such as a ring or hanger. As described hereinbelow, the universal carabiner holder of the present invention is configured to receive, hold and operate with a broad selection of carabiners made by differing manufacturers, and which carabiners can come in a variety of sizes, shapes and gate arm configurations. The carabiner holder can be mounted on an extension pole and used to remotely attach the carabiner, along with its affixed safety rope, to the remote object, such as the attachment ring of the safety harness of a fallen friend or co-worker. The carabiner holder and extension pole can then be removed and the fallen co-worker pulled to safety.

The present invention provides several significant advantages over other carabiner holders, some of which are recited here and throughout the following more detailed description. For example, the present invention overcomes the limitation found with prior-art carabiner holders which requires that they must be sized to match a particular carabiner, which typically prevents the carabiner holder from being used with a carabiner of a differing size, for from another manufacturer, or which employs a different auto-locking gate arm configuration. This adaptability and flexibility removes the burden on the safety and rescue team to ensure that the carabiners and carabiner holders are procured and/or matched together prior to use, and that the matching holders and carabiners must be kept separate from other equipment to ensure there are no mis-matches that could delay a response in an emergency situation. This adaptability also removes the selection requirement that only a single supplier or size of carabiner be used at a particular facility in order to avoid mis-matching the carabiner holder with the carabiner, allowing for greater flexibility in purchasing decisions.

Each of the above-recited advantages will be apparent in light of the detailed description set forth below and best understood with reference to the accompanying drawings, wherein the elements and features of the invention are designated by numerals throughout. These advantages are not meant to be limiting in any way. Indeed, one skilled in the art will appreciate that other advantages may be realized, other than those specifically recited herein, upon practicing the present invention.

With reference to FIGS. 1-8, illustrated is a universal carabiner holder 10 in accordance with an exemplary embodiment of the present invention. Shown in a close-up, perspective view in FIG. 1, the carabiner holder can include an axial stem or elongate body 20 for supporting or facilitating the support of the carabiner. A gripping means 50 can extend outwardly from one end of the axial stem for releasably capturing a spine of the carabiner and for holding a gate arm of the carabiner in the open position. In the embodiment shown, the gripping means 50 can further comprise a fixed jaw arm 22 and a moveable jaw arm 42 which are biased together by a spring mechanism 48. When positioned adjacent each other, the fixed jaw arm 22 and moveable jaw arm 42 can together form a top opening 52 for receiving the spine of the carabiner.

The elongate body 20 can further comprise a mid-span or center section 24 which can be an extension of the fixed jar arm 22 in the embodiment 10, as illustrated in FIG. 1. The elongate body can further include a base end 26 opposite the gripping means 50. The base end 26 of the elongate body 20 can include provisions for attaching or coupling a supporting means 60, which can extend outwardly from the elongate body 20 in the same direction as the gripping means located at the opposite end of the elongate body. The supporting means 60 can be configured for restraining the base of the carabiner, and can further include a base section 64 and a supporting section 62 having structure for receiving and restraining the base portion of the carabiner to prevent twisting of the carabiner within the carabiner holder.

The distance d separating the supporting section 62 of the supporting means 60 from the gripping means 50 can define an axial gap 70. This axial gap 70 can be varied or adjusted as needed to accommodate carabiners of differing size, shape and/or gate arm configurations. In the embodiment 10 shown, the variable axial gap 70 can be provided by a supporting means 60 that is flexible or resilient or moveable in the axial direction, and biased towards the fixed gripping means 50.

A mounting screw 14 for coupling the carabiner holder 10 to an extension pole can extend from the bottom of the base 26 of the holder. It is to be appreciated that any means for securing the present invention to an extension pole, whether it is a screw, spline fitting, clamp, bolts, glue, etc., falls within the scope of the present invention. An electrically insulating adaptor for high voltage tower rescue may also be attached between the carabiner holder and the extension pole.

Figure 2:
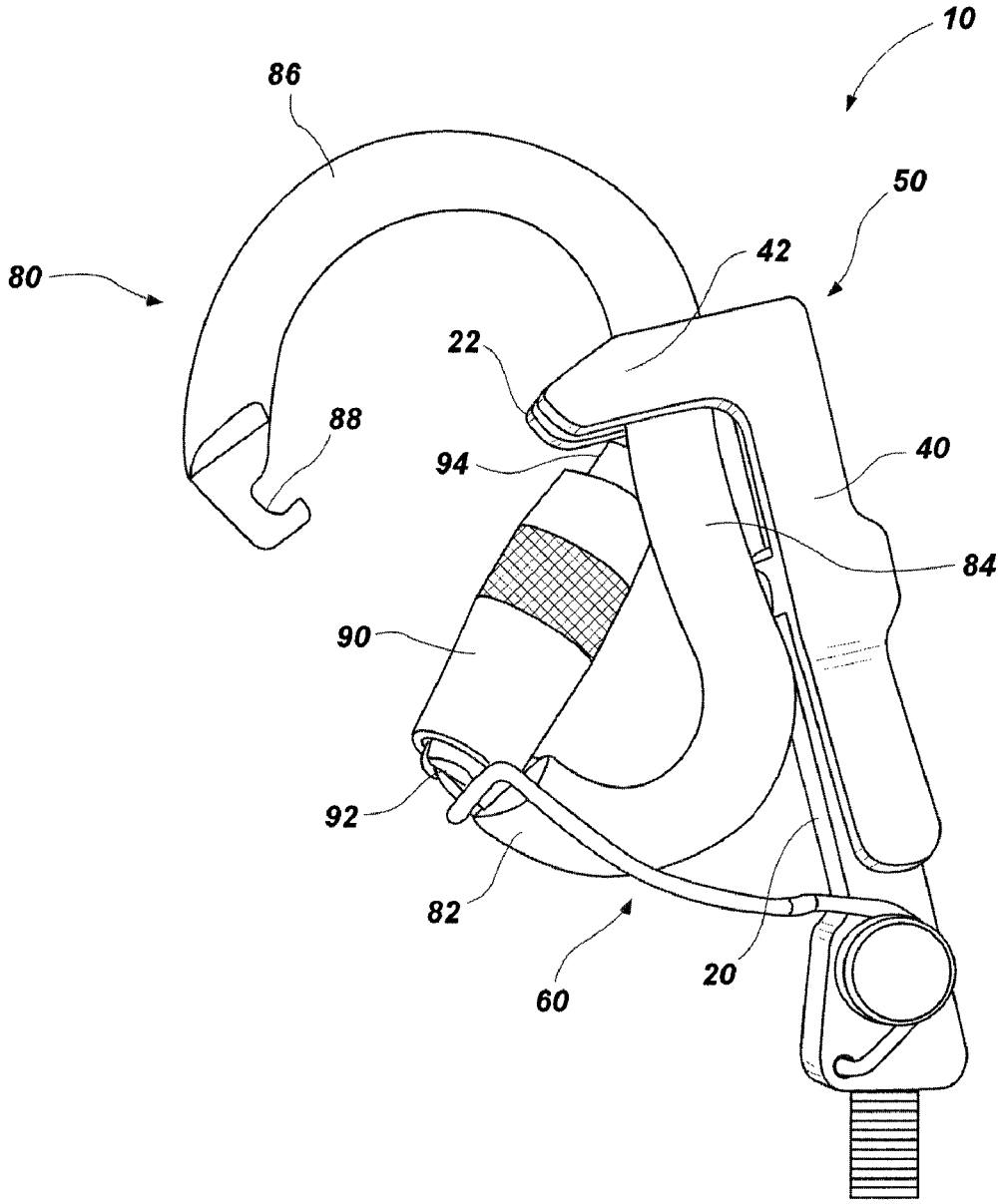
FIG. 2 illustrates another perspective view of the carabiner holder of FIG. 1 having an installed carabiner.

FIG. 2 illustrates a perspective view of the carabiner holder 10 of FIG. 1 having an installed carabiner 80. The carabiner 80 can comprise a base portion 82, a spine portion 84, a hook portion 86 and a gate arm portion 90. The gate arm 90 can be pivotably attached to the base 82 at pivot point 92, so that the gate arm pivots inward to rest the locking tip 94 of the gate arm against the inside surface of the spine when the carabiner is placed the open position. The gate arm 90 can also be spring-loaded or biased towards the closed position, and when allowed to close the locking tip 94 of the gate arm can engage with a corresponding locking notch or fixture 88 located on the tip of the hook portion to form an annular body. In one aspect of the invention, the carabiner can include an auto-locking gate arm to prevent the accidental opening of the gate arm if the rope were to move around and apply pressure to the front of the gate arm.

As can be seen in FIG. 2, the configuration of the axial stem 20, the gripping means 50, and the supporting means 60 can define a quadrant of capture in which the carabiner 80 may be positioned. In one aspect, the carabiner holder can be configured so that the carabiner 80 may only be orientated in one position in order for the device 10 to operate correctly, such as when the back of the spine 84 of the carabiner contacts the axial stem 20, the base of the carabiner 82 rests within the supporting means 60, and the carabiner opening or hook portion created when the gate arm 90 is placed in the open position, faces away from the carabiner holder 10. This can advantageously position the hook portion 86 of the carabiner in the most exposed orientation for hooking onto a hanger, such as the D-ring of a safety harness. Nevertheless, other orientations of the carabiner within the carabiner holders are also possible, such as when the gripping means and supporting means releasably secure the carabiner from one side or the other of the carabiner. Thus, as many alternative configurations as can be appreciated by one of skill in the art for providing a carabiner holder having a variable axial gap defined by the gripping means and the supporting means is considered to fall within the scope of the present invention.

Figure 3:
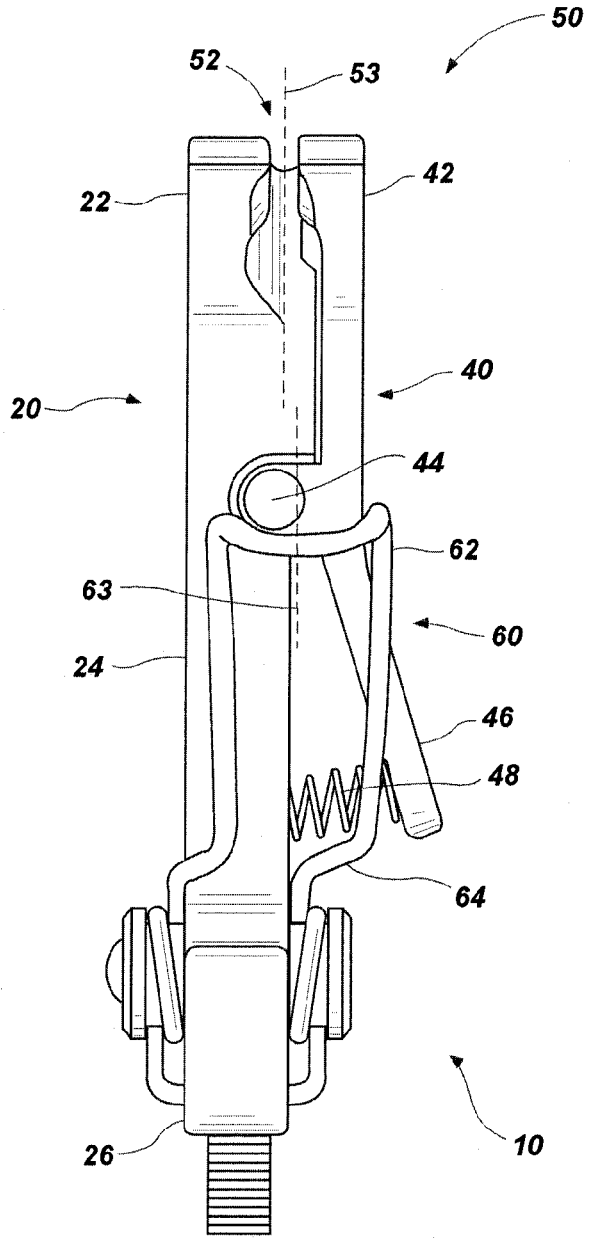
FIG. 3 illustrates a front view of the carabiner holder of FIG. 1.
Figure 4:
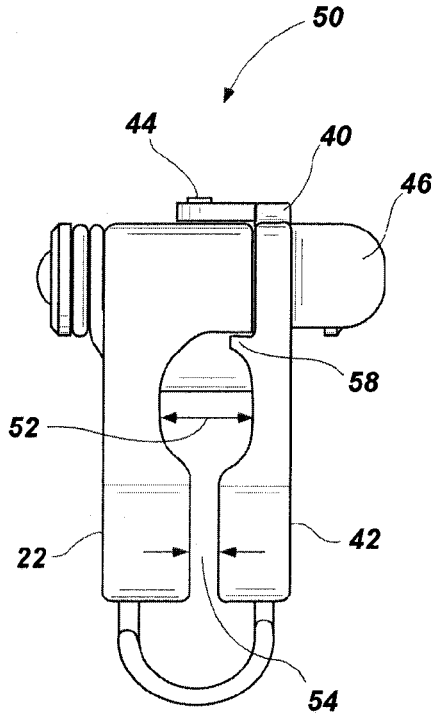
FIG. 4 illustrates a top view of the carabiner holder of FIG. 1.

The gripping means of the carabiner holder can be used both for gripping the spine of the carabiner and for holding the gate arm in the open position. In the representative embodiment 10 of the carabiner holder illustrated in FIG. 3, the gripping means 50 can comprise a fixed jaw arm 22 extending from the upper end of the axial stem 20, and a moveable jaw arm 42 extending from the upper portion of a pivoting grip lever 40. Referring to FIGS. 3-4, the grip lever 40 can be attached to a mid-span of the axial stem 20 at a pivot point 44, and can further include a pivot handle 46 which extends downwardly and outwardly away from the axial stem to provide a leverage point for pivoting the grip lever 40. A coil spring 48 or similar biasing device can be positioned between the pivot handle 46 and the axial stem 20 to force or bias the movable jaw arm against the fixed jaw arm and preload the gripping device in the closed position.

In another aspect of the present invention (not shown) the grip lever could extend rearwardly behind the gripping features of the fixed and movable jaw arms, with the pivot point having a vertical axis of rotation being located on backside surface of the axial stem, as opposed to the horizontal or lateral axis of rotation shown in FIGS. 2-4. Other configurations for the gripping means are also possible, including paddles or jaw arms of any shape or size which extend into the quadrant of capture, and which can be both separately or integrally formed with the axial stem. Moreover, while the embodiment illustrated uses a coil spring in compression to establish the pre-load in the gripping means, a coil spring in tension, a metal leaf spring, an elastomeric member, or any other component which performs the same function of preloading the set of jaw arms in the closed position can also be considered to fall within the scope of the present invention. Thus, it is contemplated that any alternative means or structure for securing the carabiner in the quadrant of capture and for holding the gate arm in the open position falls within the scope of the present invention.

As can be seen in the top view of the gripping means 50 illustrated in FIG. 4, in a neutral, non-operational state a small gap 54 exists between the front portions of the fixed jaw arm 22 and the moveable jaw arms 42 that is too small for a carabiner to slip between. This gap opens into the top opening 52 between the mid-portions of the fixed jaw arm 22 and the moveable jaw arms 42. The top opening 52 is a split, rounded opening that is configured to receive and hold the spine of the carabiner. In the embodiment shown, one of the jaw arms, in this case the moveable jaw arm, can have an interior projection 58 interrelating with a back surface of the opposite jaw arm. The interior projection 58 can act to maintain a substantially round opening, and specifically to maintain a closed back surface of the rounded top opening 52 when the jaw arms are separated, and to prevent a carabiner having a backside ridge from inadvertently sliding into and becoming bound with the backside split between the two jaw arms.

When installing a carabiner, the gap 54 and top opening 52 are opened by pressing against the pivot handle 46 to rotate the grip lever 40 about jaw arm pivot point 44 and to move the movable jaw 42 arm away from the fixed jaw arm 22. This simultaneously compresses the coil spring 48 (FIG. 3) and widens the gap 54 between the front portions of the jaw arms. The carabiner's spine can then be inserted into the top opening 52 and positioned within the quadrant of capture. When the pivot handle 46 is released, the coil spring pushes the jaw arms closed about the spine of the carabiner. However, the coil spring is unable to completely return to its neutral position because of the thickness of the carabiner's spine, leaving residual compression forces in the spring that continue to force the top opening 52 closed around the carabiner. These clamping forces serve to hold the carabiner in place against any external load which might otherwise pull the carabiner out of position, as well as any inadvertent shaking or bouncing caused by agitated or unskilled users.

Referring back to FIG. 2, it can be seen that the gripping means 50 also serves to hold the gate arm 90 of the carabiner 80 in the open position to expose the hook portion 86 of the carabiner. In one aspect this can be accomplished by positioning the locking tip 94 of the gate arm against the underside surface of the fixed jaw arm 22 after the jaw arms have closed about the carabiner's spine 84. In another aspect of the invention, the locking tip 94 can become wedged between the front surface of the spine 84 and the underside surfaces of both jaw arms. Moreover, in both configurations the supporting means and gripping means can be biased towards each other to secure the carabiner into its open position within the carabiner holder, and to prevent the gate arm 90 from prematurely releasing from the gripping means and the carabiner 80 from inadvertently slipping out of the carabiner holder 10 during the process of hooking the carabiner into a target, even if the user fails to keep the carabiner holder steady.

Figure 5:
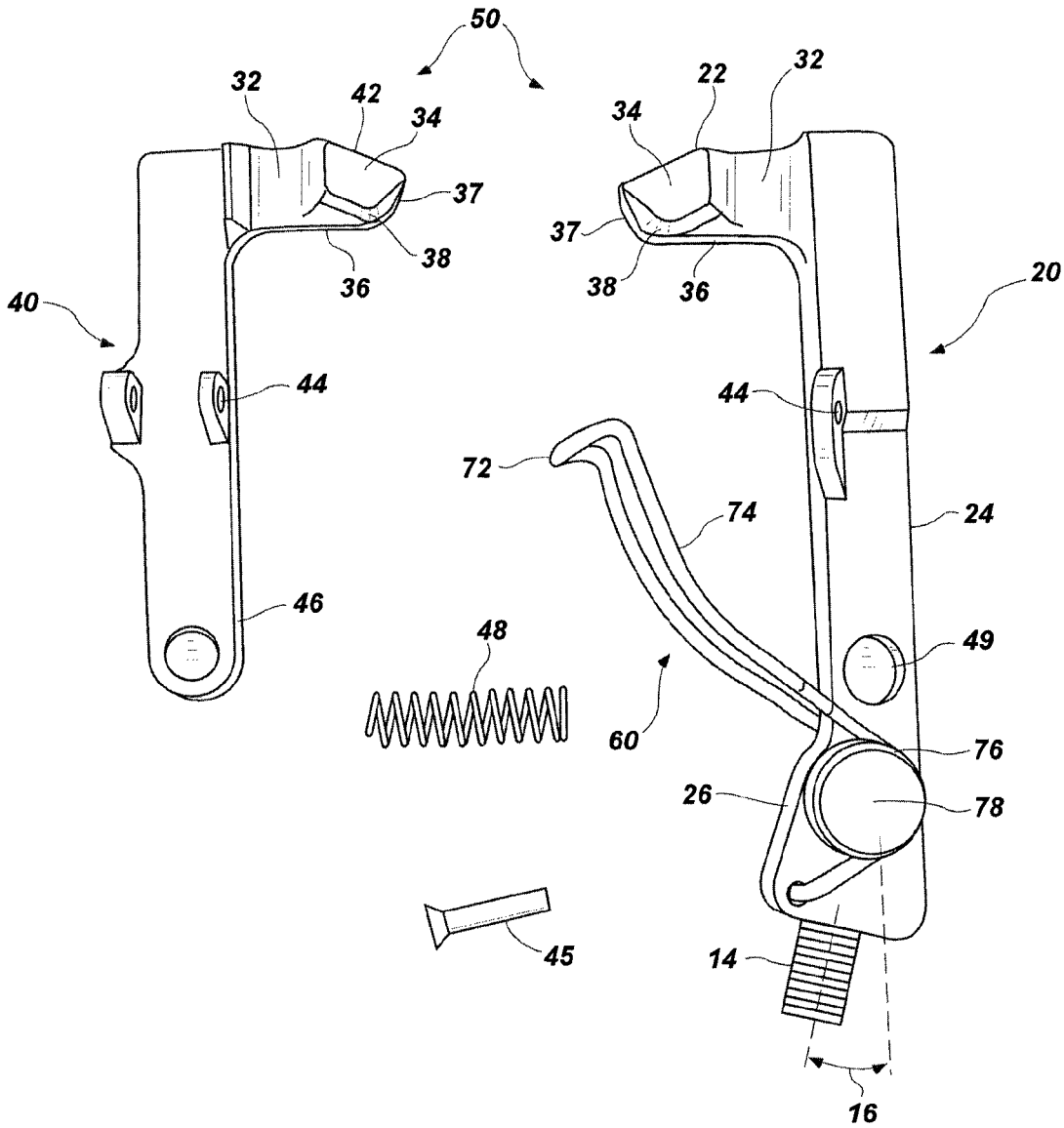
FIG. 5 illustrates a side-view of the dis-assembled jaw arms, the jaw arm spring and jaw arm axle of the carabiner holder of FIG. 1.

The interior and lower surfaces of the jaw arms are shown in more detail in the side view of the dis-assembled jaw arms found in FIG. 5. Each jaw arm 22, 42 can have a mid-portion with an interior concave surface 32 forming one half of the top opening, and a front portion with an interior face 34 forming one half of the narrow gap. Each jaw arm can also include a bottom surface 36 for contacting the locking tip of the gate arm of the carabiner, as described hereinabove. Moreover, each jaw arm can also be formed with an angled or interior chamfered surface 38 between the bottom surface 36 and the interior face 34, along with a canted lower tip surface 37 that angles upwardly and outwardly from the bottom surface 36 to form a pointed tip into the outer face of each jaw arm. Both the chamfered interior surfaces 38 and the canted tip surfaces 37 can facilitate separating the carabiner holder 20 from the carabiner 80 and its attached rope after the carabiner has been successfully locked into the remote ring or hanger.

Illustrated in both FIGS. 3 and 5 is center section 24 of the axial stem 20 which separates the gripping means 50 or jaw arms 22, 42 extending from the upper end of the axial stem 20 from the supporting means 60 extending from the base end 26. The center section 24 of the axial stem 20 provides the unifying structure connecting the gripping means and the supporting means. In the embodiment shown the center section also provides the location for the pivot attachment point 44, or where the grip lever 40 is coupled to the axial stem 20 with a pivot pin 45 or similar attachment device. The center section 24 can also provide the location for the circular recess 49 that holds one end of the coil spring 48 after assembly.

As viewed from the front in FIG. 3, the center section 24 and base 26 of the axial stem 20 can be offset from the longitudinal central axis 53 of the top opening 52 in order to accommodate the grip lever 40. As the supporting means 60 is attached to the base 26 of the axial stem, the base section 64 of the supporting means can be provided with a lateral offset to re-align the longitudinal center axis 63 of the support section 62 of the supporting means 60 with the longitudinal central axis 53 of the top opening, so that both axes fall into a substantially common vertical or longitudinal plane of capture when the spine of a carabiner is installed into the top opening. This lateral offset can ensure that the spine of the carabiner is vertically aligned with the axial stem when placed within the carabiner holder 10 with its gate arm in the open position, and provides for a more secure connection between the carabiner and the carabiner holder.

Referring back to FIG. 5, in one aspect the supporting means 60 of the carabiner holder 10 can comprise a moveable or resilient looped wire cradle 72 having a support section 74 and a coil spring section 76 mounted around a wire frame pivot point 78, and which is spring-loaded or biased in the axial direction. The looped wire cradle 72 can be used both to restrain the base of the carabiner and to resiliently support or bias the carabiner towards the gripping means. In the representative embodiment shown, for example, the shape of the support section 74 can substantially conform to the round or contoured profile of the carabiner's base and function as a restraining structure which first aligns the carabiner in the quadrant of capture, and then prevents twisting and inadvertent dislodging of the carabiner during use. The support section 74 can be effective in preventing twisting both because the rounded or contoured cross-section of the carabiner's base can nestle between the loops of the wire cradle, and because the outwardly-projecting support section 74 in essence becomes a lever arm which applies sufficient restraining force at a radial distance from the longitudinal axis of the secured spline to keep the carabiner from spinning.

Also shown in FIG. 5, the mounting screw 14 for attaching the carabiner holder 10 to an extension pole can extend downward from the base end 26 of the axial stem at an angle 16 relative to the longitudinal axis of the axial stem 20. Once mounted to the end of extension pole, this angle can operate to position the axial stem in a forward-leaning posture, so that the hook portion of a releasably installed carabiner is oriented at a better angle for hooking around a remote ring or hanger. In one aspect angle 16 can range from zero degrees to thirty degrees, and in the exemplary embodiment shown can be about fifteen degrees.

Figure 6A:
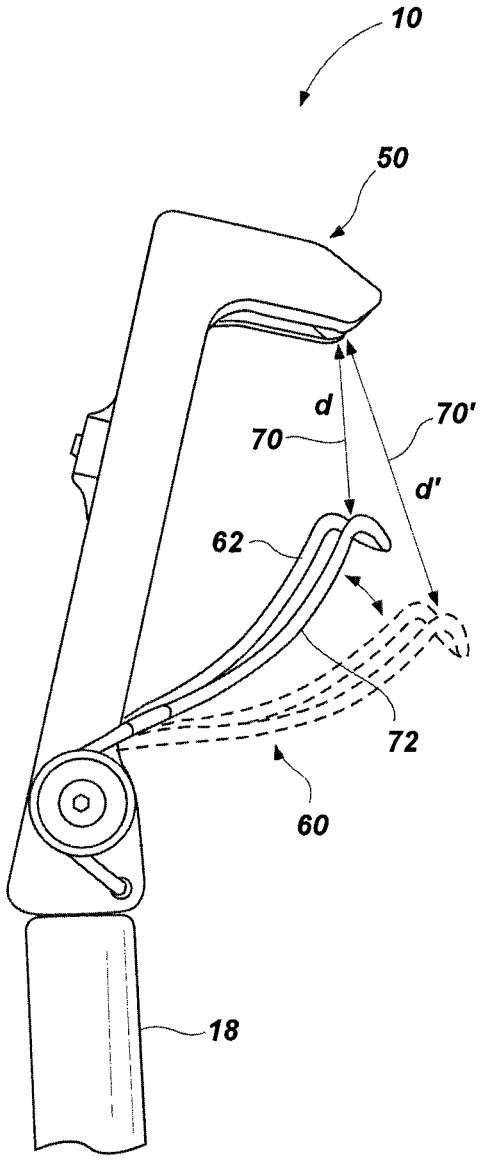
FIGS. 6A-6B together illustrate the left- and right-hand side views, respectively, of the carabiner holder of FIG. 1.
Figure 6B:
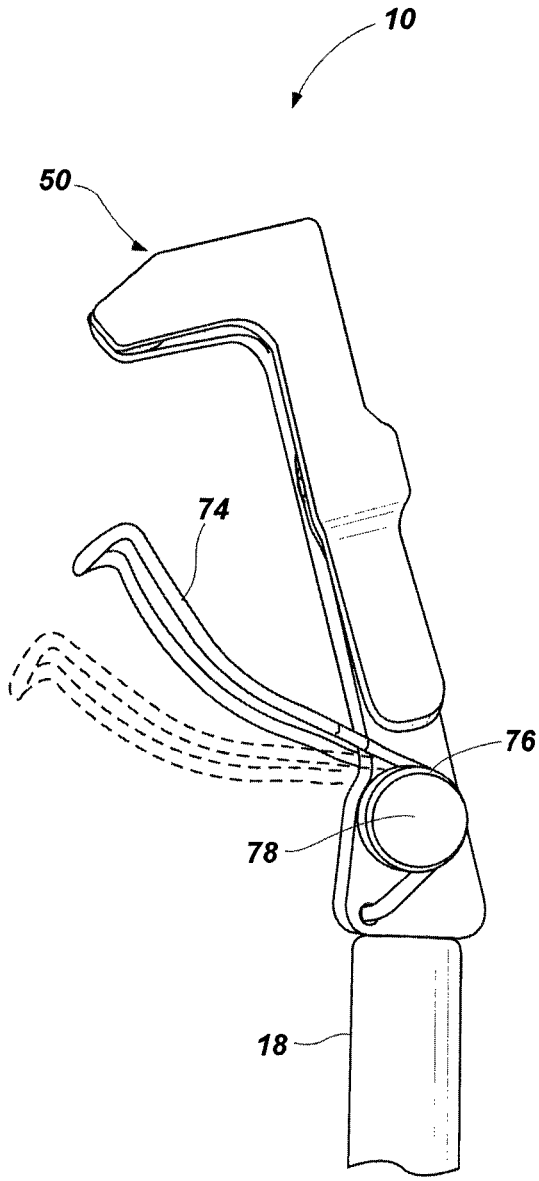

The capability of the universal carabiner holder 10 of the present invention to accommodate a broad selection of carabiners made by differing manufacturers, and which carabiners can come in a variety of sizes, shapes and gate arm configurations, is further illustrated in FIGS. 6A and 6B. As described hereinabove, the distance d separating the supporting section 62 of the supporting means 60 from the gripping means 50 can define an axial gap 70. This axial gap 70 can be varied or adjusted as needed to accommodate carabiners of differing size, shape and/or gate arm configurations. With the representative universal carabiner holder 10, this can be accomplished by flexing the spring-loaded or resilient looped wire cradle 72 downwardly in the axial direction to open a first axial gap 70 with a separation distance d to a second axial gap 70' having a distance d'. Moreover, the looped wire cradle 72 can be biased towards the gripping means 50, which serves to hold or wedge the gate arm 90 of the carabiner 80 firmly against the bottom surface(s) of the gripping means 50 when the carabiner is placed in the carabiner holder in the open position to expose the hook portion 86 of the carabiner, as shown in FIG. 2.

For the universal carabiner holder 10 shown in FIGS. 6A and 6B, the biasing force can be provided, at least in part, by the coil spring section 76 of the wire frame mounted around the pivot point 78. Thus, with the embodiment 10 of the present invention the upper support section 74 and the spring section 76 can be simultaneously flexed to increase the gap between the supporting means 60 and the gripping means 50. However, it is to be appreciated that other structures can be used to accomplish this same function and still fall within the scope of the present inventions. For instance, it is contemplated a supporting bracket having a solid structure pivoting about its base and a coil spring or a leaf spring providing the biasing force toward the gripping means could also be used.

Also shown in FIGS. 6A-6B is the tip of an extension pole 18 which can be connected to the carabiner holder 10 via the attachment screw. The extension pole can be formed of any suitable material such as aluminum, wood, plastic or fiber-reinforce composite, etc. which has the necessary length, strength and rigidity to support the carabiner holder, the carabiner, and the attached safety rope across the distance separating the rescuer from the fallen or incapacitated party. In one aspect of the invention the extension pole can be telescoping for additional length, and in another aspect of the invention the extension pole can be electrically insulated to allow for use in and around the power poles or towers which support high-voltage power lines.

Figure 7:
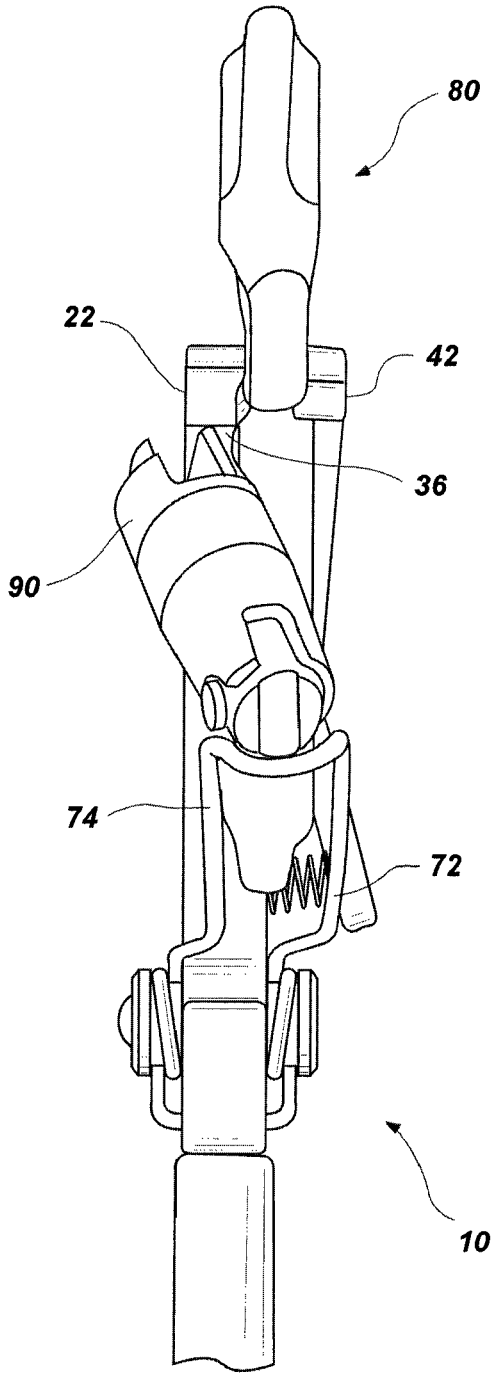
FIG. 7 illustrates a front view of the carabiner holder of FIG. 1 having an installed carabiner with a side-opening gate arm.
Figure 8:
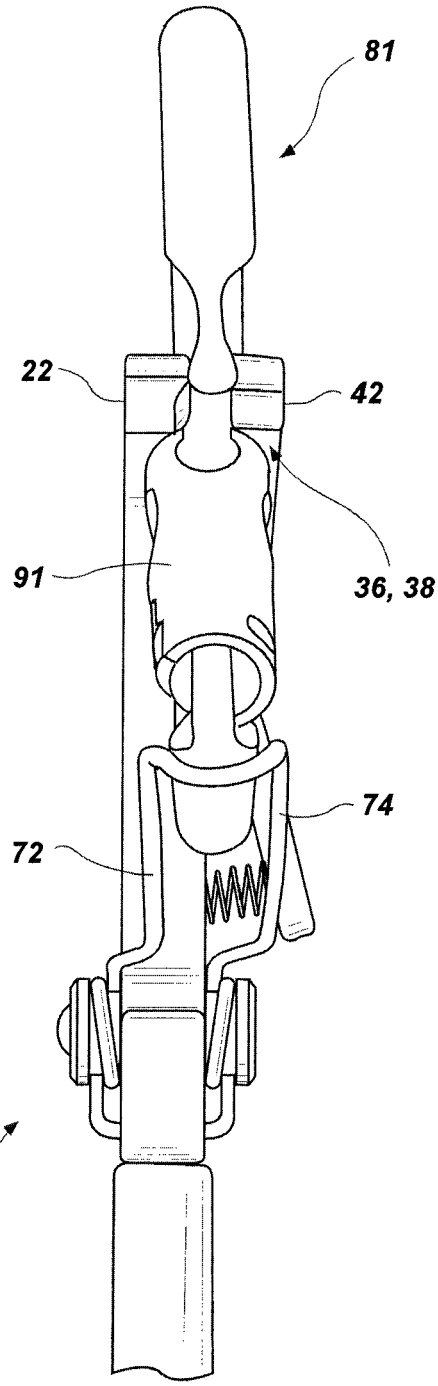
FIG. 8 illustrates a front view of the carabiner holder of FIG. 1 having an installed carabiner with a straight-opening gate arm.

FIGS. 7 and 8 are front views of the carabiner holder 10 having two different types of carabiners 80, 81 that are each releasably installed into the respective universal carabiner holders 10 of the present invention. In both cases the spines of the carabiners are secured by the fixed and movable jar arms 22, 42 and the bases of the carabiners are nestled into and restrained by the support sections 74 of the spring-loaded or resilient looped wire cradles 72. However, as shown in FIG. 7, carabiner 80 has a side-opening gate arm 90 that folds to one side when opened, and which is releasably secured against the underside surface 36 of the fixed jar arm 22. In contrast, the carabiner 81 shown in FIG. 8 has a straight-opening gate arm 91 that folds directly backwards, and which is releasably secured against the underside surfaces 36 and chamfered interior surfaces 38 of both gate arms. Thus, it is to be appreciated that the universal carabiner holder 10 of the present invention is capable of accommodating any one of a plurality of carabiners of different configuration, as well as any one of a plurality of carabiners of different size.

Illustrated in FIGS. 9-14 is a method 100 for installing a carabiner 120 to a remote ring or hanger 112 using the universal carabiner holder 140, in accordance with one representative embodiment of the present invention. For instance, in one situation the remote ring or hanger 112 can comprise a D-ring attached to standard safety or fall-arrest harness 110, and which can may often be located between the shoulder blades of the fallen, unconscious or otherwise incapacitated co-worker wearing the harness.

As described above, the carabiner 120 can further comprise a base 122, a spine 124, a hook portion 126 and a pivotable gate arm 128, with the base, spine, hook portion and gate arm together forming an annular body when the gate arm is in the closed position. Additionally, a safety rope 130 can be affixed or looped into the carabiner 120.

The method 100 includes the step of obtaining a carabiner holder 140 coupled to an extension pole 150, wherein the carabiner holder comprises an axial stem 142 having a gripping means 144 at a first end and a supporting means 146 at the second end, and wherein an axial gap between the gripping means and the supporting means is variable.

Figure 9:
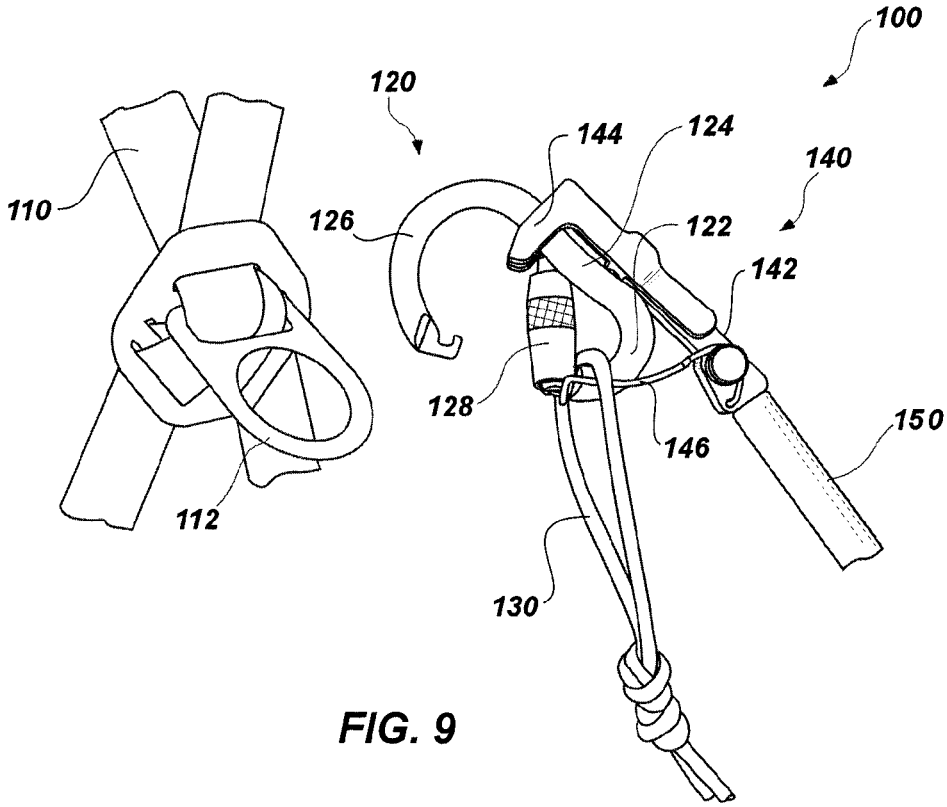
FIG. 9 illustrates a step in a method for installing a carabiner to a remote ring or hanger, in accordance with an exemplary embodiment of the present invention.

As shown in FIG. 9, the method includes the step of positioning the carabiner 120 with its attached rope 130 within the axial gap, with the spine 124 of the carabiner releasably captured by the gripping means 144 and the base 122 of the carabiner restrained by the support means 146, and wherein the gate arm 128 of the carabiner is secured in an open position through contact with the gripping means 144 to expose the hook portion 126 of the carabiner. In one aspect of the invention, the gripping means 144 can be fixed relative to axial stem 142, while the supporting means 146 can be flexibly biased towards the gripping means 144, for providing the variable axial gap and to further hold the gate arm 128 of the carabiner against the underside of gripping means. For example, the supporting means can comprise the spring-loaded or resilient looped wire cradle described hereinabove.

Figure 10:
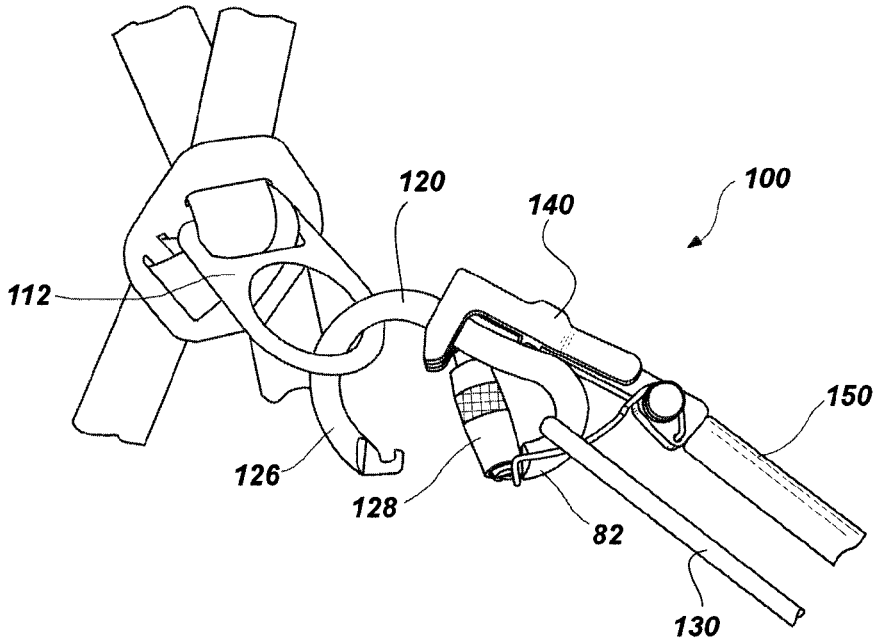
FIG. 10 illustrates an additional step in the method of FIG. 9.

As shown in FIG. 10, the method 100 includes the step of hooking the carabiner 120 into a remote ring 112 or hanger by extending the carabiner holder 140 on the extension pole 150 and sliding the hook portion 126 of the carabiner into the remote ring or hanger.

Figure 11:
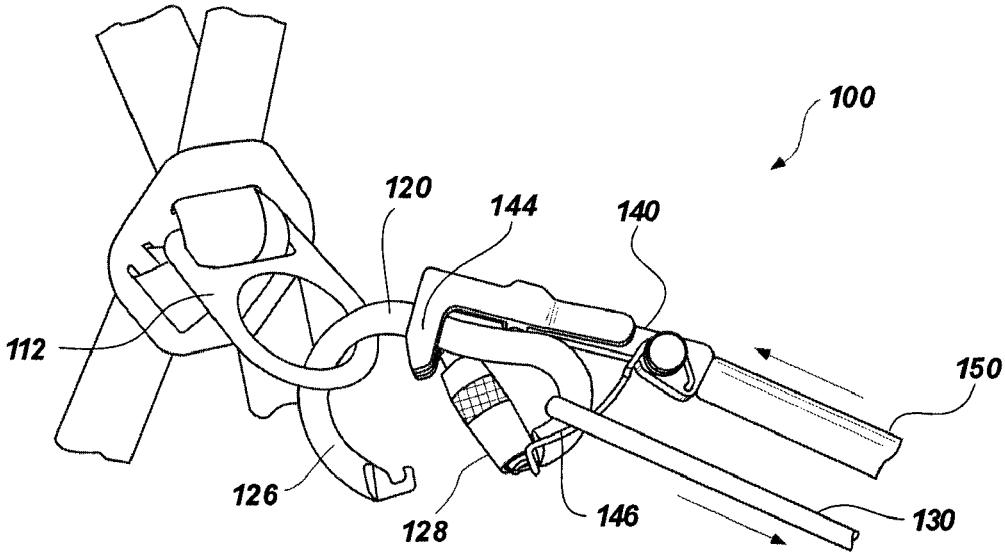
FIG. 11 illustrates an additional step in the method of FIG. 9.
Figure 12:
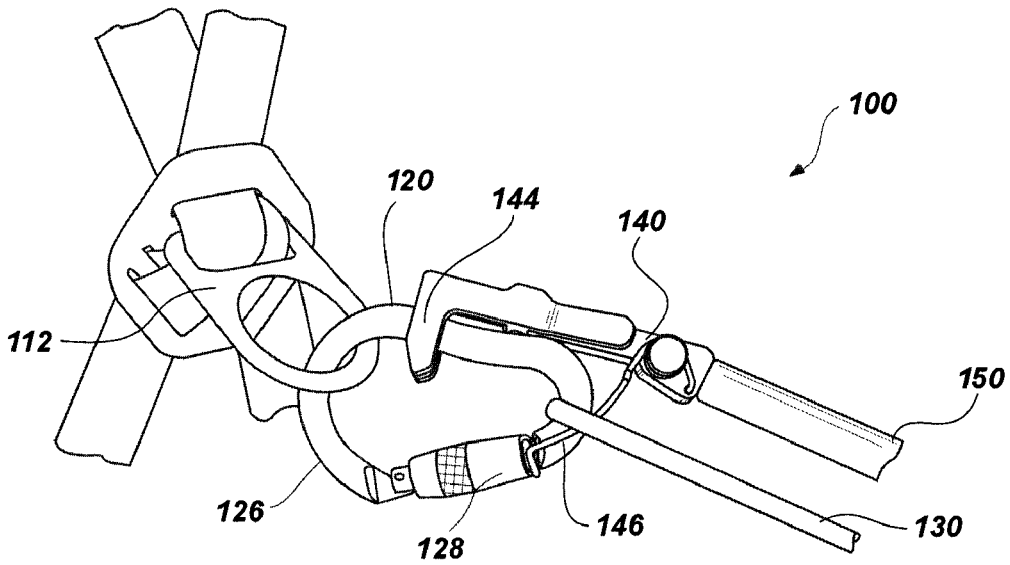
FIG. 12 illustrates an additional step in the method of FIG. 9.

As shown in FIGS. 11-12, the method 100 includes the step of causing the axial gap to open, to release the gate arm 128 from the gripping means 144 and snap closed about the remote ring 112 or hanger. This can be accomplished by pushing away with the extension pole 150 or holding the extension pole steady, while simultaneously pulling inward with the attached rope 130, as illustrated in FIG. 11. Pulling inward with the rope 130 bends the resilient supporting means 146 downwards, increasing the axial gap until the gate arm 128 can slide out from under the gripping means 144 and snap shut and lock into the hook portion 126 of the carabiner, as illustrated in FIG. 12.

Figure 13:
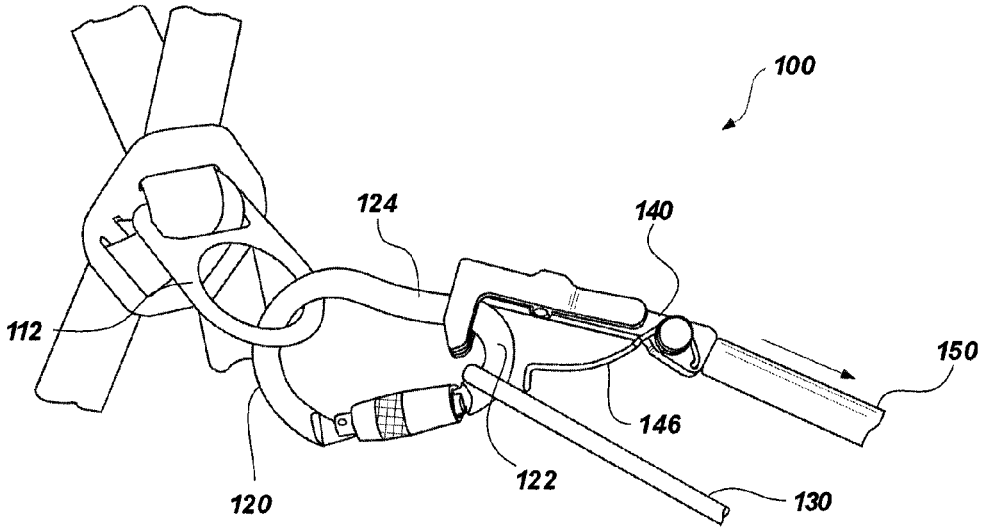
FIG. 13 illustrates an additional step in the method of FIG. 9.
Figure 14:
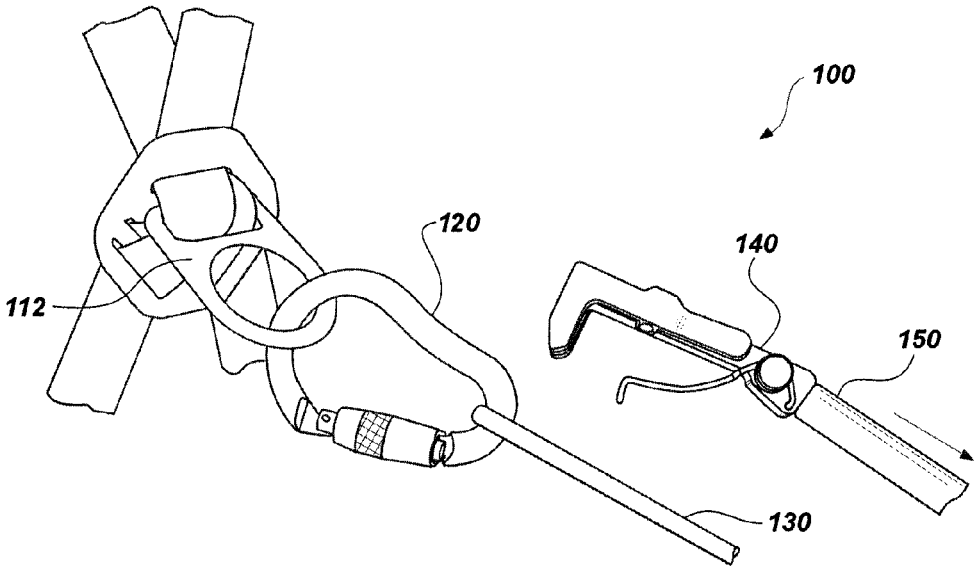
FIG. 14 illustrates an additional step in the method of FIG. 9.

In one aspect of the present invention, the method 100 can further include the step of withdrawing the carabiner holder 140 from the locked carabiner 120, as shown in FIGS. 13-14, by pulling on the extension pole 150 until the carabiner holder slips off the carabiner, leaving the carabiner and attached rope 130 locked into the ring 112 of the safety harness. As described above in reference to FIG. 5, the chamfered interior surfaces and the canted tip surfaces of the jaw arms can facilitate separating the carabiner holder 140 from the carabiner 120 and its attached rope 130 after the carabiner has been locked into the remote ring 112 or hanger. For example, pulling backward on the extension pole 150 can cause the chamfered interior surfaces to bear against the rounded base 122 and spine 124 of the carabiner (see FIG. 13), creating an outwardly-projecting force which pushes open the jaw arms and allows the gripping means to release the spine of the carabiner. Alternatively, pulling backward on the extension pole 150 can also cause the canted tip surfaces to bear against the attached rope and create a forwardly-directed force which pushes the rope away from the jaw arms and prevents the gripping means from becoming caught up by the rope.

Figure 15A:
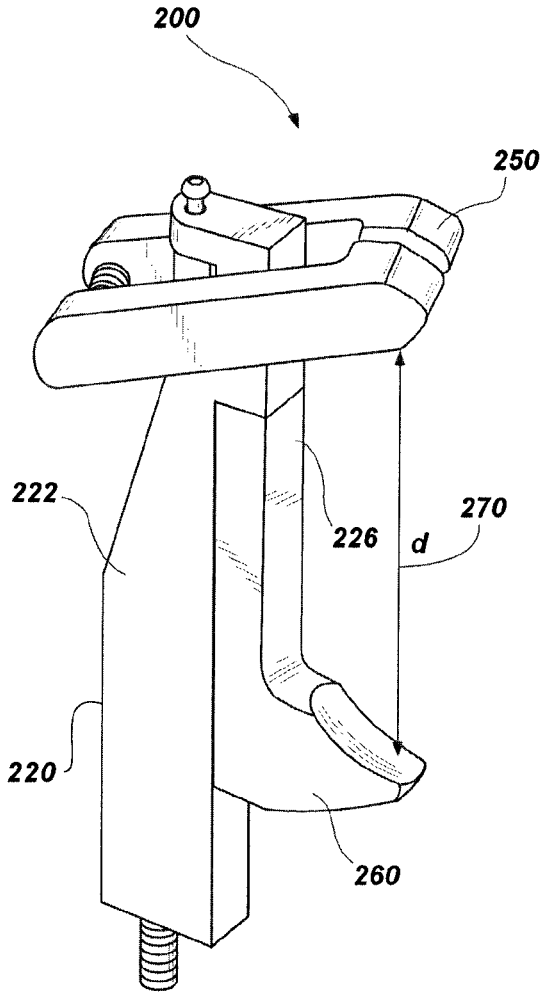
FIGS. 15A-15B together illustrate perspective views of the carabiner holder having a reduced and expanded axial gap, respectively, in accordance with another exemplary embodiment of the present invention.
Figure 15B:
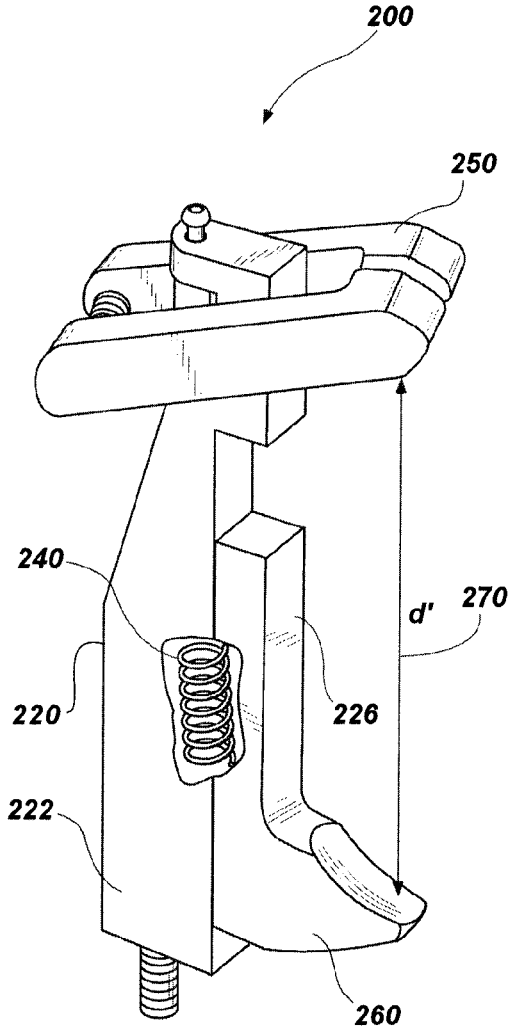

Another representative embodiment 200 of the present invention is illustrated in FIGS. 15A and 15B, in which a variable axial gap 270 is provided by an axial stem 220 which has been separated into an upper component 222 and a lower component 226, which upper and lower components can be moveable with respect to each other and can be biased towards each other. The gripping means 250 can be attached to the upper component 222 while a rigid supporting means 260 can be attached to the lower component. A biasing element or means, such as a coil spring 240, can be installed within the axial stem to provide the biasing force which forces the supporting means 260 towards the gripping means 250 and serves to hold or wedge the gate arm of the carabiner firmly against the bottom surface of the gripping means when the carabiner is positioned in the carabiner holder in the open position. While carabiner holder 200 is illustrated as having a lower component 226/supporting means 260 that is moveable or slidable and an upper component 222/gripping means 250 that is fixed to the axial stem 220, it is to be appreciated that the arrangement can be reversed, and that lower component/supporting means can be fixed to the axial stem while the upper component/gripping means can be moveable.

Figure 16A:
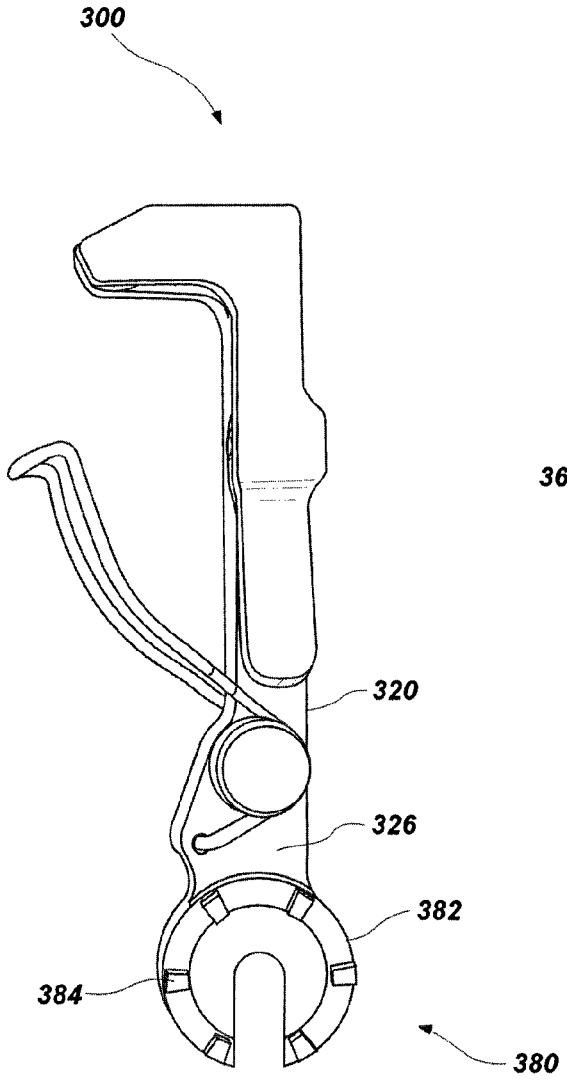
FIGS. 16A-16B together illustrate perspective side views of the carabiner holder having an adjustable connection interface with an extension pole, in accordance with yet another exemplary embodiment of the present invention.
Figure 16B:
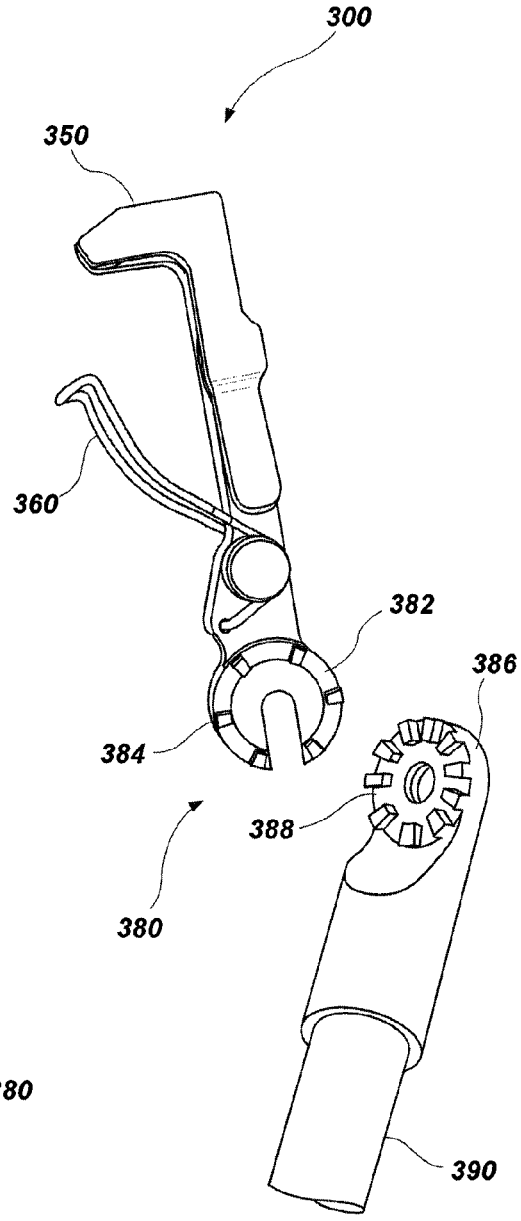

Another representative universal carabiner holder 300 is shown FIGS. 16A and 16B, in which the mounting screw of the previous embodiment has been replaced with the male side 382 of an adjustable spline adapter coupling 380 that extends downward from the base portion 326 of the axial stem 320. In one aspect the male side 382 of the spline adapter and the axial stem 320 can be integrally formed together from the same piece of material, such as a machined piece of aluminum stock, for greater strength and durability. The male side 382 of the spline adapter has a plurality of projecting splines 384 projecting outwardly from a circular face, and which can interrelate with a plurality of corresponding slots 388 formed into a female side 386 of the adapter 380 that is mounted on the end of the extension pole 390, such as an insulated hot stick used in the electrical power line industry. A thru-bolt (not shown) can pass through the center slot and hole of the spline adapter components to fasten the male and female sides together in one of a plurality of pre-defined angular orientations, allowing the gripping means 350 and supporting means 360 of the carabiner holder to be positioned at an optimum angle relative to longitudinal axis of the extension pole 390.

Figure 17:
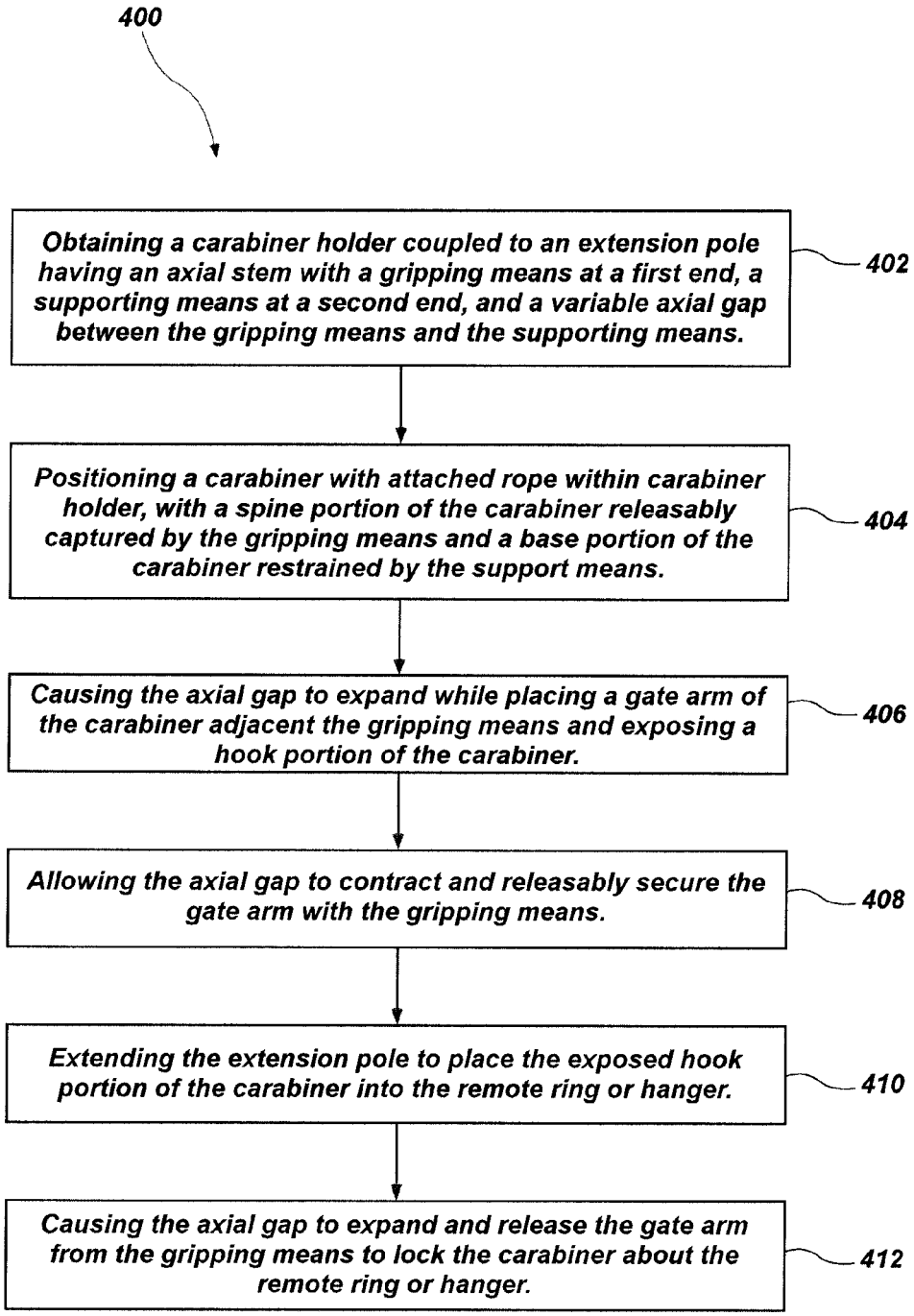
FIG. 17 is a flowchart depicting a method for locking a carabiner into a remote ring or hanger, in accordance with yet another exemplary embodiment of the present invention.

FIG. 17 is a flowchart depicting another representative method 400 for method for locking a carabiner into a remote ring or hanger. The method includes the step of obtaining 402 a carabiner holder coupled to an extension pole, the carabiner holder having an axial stem with a gripping means at a first end, a supporting means at a second end, and a variable axial gap between the gripping means and the supporting means. The method further includes positioning 404 the carabiner with an attached rope within carabiner holder, with a spine portion of the carabiner releasably captured by the gripping means and a base portion of the carabiner restrained by the support means, causing 406 the axial gap to expand while placing a gate arm of the carabiner adjacent the gripping means and exposing a hook portion of the carabiner, and allowing 408 the axial gap to contract and releasably secure the gate arm with the gripping means. The method also includes extending 410 the extension pole to place the exposed hook portion of the carabiner into the remote ring or hanger, and causing 412 the axial gap to expand and release the gate arm from the gripping means to lock the carabiner about the remote ring or hanger.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A carabiner holder mountable on an extension pole for holding and installing a carabiner to a remote attachment ring, the carabiner holder comprising:

an axial stem for facilitating support of a carabiner;

gripping means extending from the axial stem for releasably capturing a spine of the carabiner and for holding a gate arm of the carabiner in an open position, wherein the gripping means comprises a fixed jaw arm, a moveable jaw arm, and a rounded top opening therebetween for capturing the spine of the carabiner, the moveable jaw arm being pivotably coupled to the axial stem and biased towards the fixed jaw arm;

supporting means extending from the axial stem opposite the gripping means for restraining a base of the carabiner, wherein an axial gap defined by the gripping means and the supporting means is variable to accommodate a plurality of carabiners of different size, wherein the gripping means is fixed relative to the axial stem and the supporting means is moveable in an axial direction and biased towards the gripping means for providing the variable axial gap.

2. The carabiner holder of claim 1, wherein the gate arm of the carabiner is held in the open position against an underside of the fixed jaw arm.

3. The carabiner holder of claim 1, wherein one of the jaw arms further comprises an interior projection interrelating with a back surface of the other jaw arm to maintain the rounded top opening when capturing differently-sized spines of differently-sized carabiners.

4. The carabiner holder of claim 1, wherein the supporting means is moveable about a pivot point at the base of the axial stem.

5. The carabiner holder of claim 1, wherein the supporting means comprises a looped wire cradle having a centerline offset from a centerline of the axial stem and substantially aligned with a centerline of the rounded top opening.

6. The carabiner holder of claim 1, wherein each of the jaw arms has a canted lower tip surface angled upwardly and outwardly from the supporting means for deflecting against a rope coupled to an installed carabiner.

7. The carabiner holder of claim 1, wherein the axial stem further comprises a first axial component for supporting the gripping means and a second axial component for supporting the supporting means, wherein the first axial component and the second axial component are moveable with respect to each other.

8. The carabiner holder of claim 7, wherein first axial component and the second axial component are biased towards each other.

9. A carabiner holder for holding and remotely installing a carabiner, the carabiner holder comprising:

an axial stem mountable to an extension pole;

a pair of separable jaw arms extending from an upper portion of the axial stem and biased towards a closed position for releasably capturing a spine of the carabiner; and a moveable base support extending from a lower portion of the axial stem for restraining a base of the carabiner, wherein the moveable base support comprises a looped wire cradle for receiving a bottom of the carabiner therein, wherein the moveable base support is biased towards the jaw arms to hold a gate arm of the carabiner in an open position against an underside of a jaw arm.

10. The carabiner of claim 9, wherein the looped wire cradle comprises a base portion forming a coiled spring coupled to the axial stem opposite the pair of jaw arms.

11. A rescue system for remotely attaching a safety rope to an attachment ring of a safety harness comprising:

a carabiner comprising a base, a spine, a hook portion and a pivotable gate arm, the base, spine, hook portion and gate arm together forming an annular body when the gate arm is in the closed position;

a safety rope coupled to the carabiner; and a carabiner holder supported on an extension pole, comprising:

an axial stem;

a pair of separable and biased jaw arms extending from an upper portion of the axial stem for releasably capturing a spine of the carabiner; and a moveable base support extending from a lower portion of the axial stem and being biased towards the jaw arms, for restraining a base of the carabiner while releasably securing a gate arm of the carabiner in an open position against an underside of a jaw arm, wherein the moveable base support comprises a looped wire cradle for receiving a bottom of the carabiner therein.

12. The rescue system of claim 11, wherein an axial gap defined by the jaw arms and the moveable base support is variable to accommodate a plurality of carabiners of different sizes.

13. The rescue system of claim 11, wherein the axial stem supports a back of the spine of the carabiner with a gate opening of the carabiner facing outward and away from the axial stem.

14. A method for locking a carabiner into a remote ring or hanger comprising:

obtaining a carabiner holder coupled to an extension pole, the carabiner holder comprising an axial stem having a gripping means at a first end, a supporting means at a second end, and a variable axial gap between the gripping means and the supporting means wherein the supporting means comprises a looped wire cradle;

positioning the carabiner with an attached rope within carabiner holder, with a spine portion of the carabiner releasably captured by the gripping means and a base portion of the carabiner restrained by the support means;

causing the axial gap to expand while placing a gate arm of the carabiner adjacent the gripping means and exposing a hook portion of the carabiner;

allowing the axial gap to contract and releasably secure the gate arm with the gripping means;

extending the extension pole to place the exposed hook portion of the carabiner into the remote ring or hanger; and causing the axial gap to expand and release the gate arm from the gripping means to lock the carabiner about the remote ring or hanger.

15. The method of claim 14, wherein the gripping means and the supporting means are biased towards each other.

16. The method of claim 14, wherein the gate arm is releasably secured against an underside of the gripping means.

17. The method of claim 14, wherein causing the axial gap to expand comprises pushing outward on the axial stem with the extension pole while pulling inward against the supporting means with the attached rope.

18. The method of claim 14, further comprising pulling the extension pole inward until the carabiner holder releases off the carabiner and attached rope to withdraw the carabiner holder from the locked carabiner.

19. The method of claim 14, further comprising positioning a carabiner of different size within the carabiner holder, wherein the axial gap expands and contracts to a different degree.

* * * * *